US007530184B2

(12) United States Patent
Ishihama et al.

(10) Patent No.: US 7,530,184 B2
(45) Date of Patent: May 12, 2009

(54) WORKING MACHINE

(75) Inventors: Hiroyoshi Ishihama, Hiroshima (JP); Mitsuo Nakatani, Hiroshima (JP); Yasunari Watanabe, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 2 days.

(21) Appl. No.: 11/470,942

(22) Filed: Sep. 7, 2006

(65) Prior Publication Data

US 2007/0068048 A1 Mar. 29, 2007

(30) Foreign Application Priority Data

Sep. 28, 2005 (JP) ..... 2005-282047

(51) Int. Cl.
*E01H 5/06* (2006.01)

(52) U.S. Cl. ..... 37/274; 37/281; 172/701.3

(58) Field of Classification Search ..... 37/274, 37/281; 172/781, 701.1, 701.2, 701.3, 817
See application file for complete search history.

(56) References Cited

U.S. PATENT DOCUMENTS

| | | | | |
|---|---|---|---|---|
| 729,265 | A * | 5/1903 | Brazel | 37/269 |
| 3,803,733 | A * | 4/1974 | Ramsey | 37/273 |
| 5,411,102 | A * | 5/1995 | Nickels et al. | 172/781 |
| 2002/0194752 | A1* | 12/2002 | Guinard | 37/281 |
| 2005/0126052 | A1* | 6/2005 | Ono et al. | 37/281 |

FOREIGN PATENT DOCUMENTS

| | | | |
|---|---|---|---|
| JP | 4-265319 | | 9/1992 |
| JP | 8-134951 | | 5/1996 |
| JP | 10-183673 | | 7/1998 |
| JP | 2000-96602 | * | 9/1998 |
| JP | 2000-96602 | | 4/2000 |
| JP | 2003-13465 | | 1/2003 |
| JP | 2003-239318 | | 8/2003 |
| JP | 2004-84176 | | 3/2004 |

* cited by examiner

*Primary Examiner*—Thomas A Beach
(74) *Attorney, Agent, or Firm*—Oblon, Spivak, McClelland, Maier & Neustadt, P.C.

(57) ABSTRACT

A working machine having a blade is disclosed, the blade comprising a body blade and an extension blade, the body blade having a body-side mounting portion having a body-side mounting hole and the extension blade having an extension-side mounting portion having an extension-side mounting hole, the body-side mounting hole and the extension-side mounting hole being formed vertically through the body-side mounting portion and the extension-side mounting portion, respectively. Further provided are mounting members adapted to be inserted into the mounting holes to connect the body blade and the extension blade with each other, and positioning members and a cutout portion for aligning the positions of the body-side mounting hole and the extension-side mounting hole vertically with each other and inhibiting the body-side mounting portion and the extension-side mounting portion from pivoting around the mounting members.

7 Claims, 6 Drawing Sheets

WORKING MACHINE

BACKGROUND OF THE INVENTION

1. Field of the Invention

The present invention relates to a working machine having blades as soil pressing attachments.

2. Description of the Related Art

For example in Japanese Patent Laid-Open No. 2003-239318 there is described a working machine having as blades a body blade attached to the working machine and a pair of extension blades attached to both end portions in the longitudinal direction of the body blade, thereby serving as extensions of the body blade.

The working machine disclosed in the above publication is provided with a mounting pin vertically inserted removably through mounting holes formed in the main blade (body blade) and also through to-be-mounted holes formed in the extension blades, thereby connecting the main blade and the extension blades with each other, and rotation preventing means for preventing both blades from rotating around the pins. With the rotation preventing means, the extension blades are held unrotatably with respect to the main blade and in an extended attitude from the main blade.

More particularly, the rotation preventing means cause front or rear portions of the extension blades to be abutted against a rear edge of the main blade to inhibit a forward or backward movement (hereinafter referred to as "longitudinal movement") of the extension blades with respect to the main blade, thereby preventing rotation around the mounting pin.

With this blade device, however, it is necessary that the mounting holes and the to-be-mounted holes of both blades be subjected to mutual alignment (superposition) at the time of inserting the mounting pin through both blades. In this case, before insertion of the mounting pin, the mounting holes and the to-be-mounted holes can be aligned with each other longitudinally by bringing both blades into abutment with each other longitudinally. In this state, however, for superposing the mounting holes and the to-be-mounted holes vertically, it has so far been required to move both blades in the transverse direction while searching for the mounting holes and the to-be-mounted holes.

Thus, when superposing the mounting holes and the to-be-mounted holes one on the other in this blade device, it has so far been required to perform such complicated operations as first fixing longitudinal positions of the main blade and the extension blades by the rotation preventing means to align the mounting holes and the to-be-mounted holes with each other longitudinally and subsequently sliding both blades right and left relative to each other to adjust transverse positions of the mounting holes and the to-be-mounted holes.

SUMMARY OF THE INVENTION

It is an object of the present invention to provide a working machine having a body blade and an extension blade capable of being easily attached to the body blade.

The working machine of the present invention has the following basic configuration.

The working machine of the present invention has a blade, the blade comprising a body blade, the body blade having a working surface extending in a transverse direction of the working machine in an attached state to the working machine, and an extension blade attached to the body blade, the extension blade having an extension surface which extends the working surface of the body blade transversely in a preset extended attitude. The body blade is further provided with a body-side mounting portion having a body-side mounting hole as vertical through holes. The extension blade is further provided with an extension-side mounting portion having an extension-side mounting hole formed vertically contiguously to the body-side mounting hole in a positional relation corresponding to the extended attitude with respect to the body-side mounting portion. The blade further comprises pivotable mounting means adapted to be inserted into the body-side mounting hole and the extension-side mounting hole to thereby connect the body blade and the extension blade with each other removably, and positioning portions are provided in the body-side mounting portion and the extension-side mounting portion respectively and adapted to come into abutment against each other to position the body blade and the extension blade in a positional relation corresponding to the extended attitude. The positioning portions come into abutment against each other in a longitudinal direction orthogonal to both transverse and vertical directions and also in the transverse direction, thereby allowing the positions of the body-side mounting hole and the extension-side mounting hole to be aligned with each other vertically and inhibiting the body-side mounting portion and the extension-side mounting portion from pivoting around the mounting means.

According to the present invention, by mutually abutting the positioning portions provided in the body-side mounting portion and the extension-side mounting portion it is possible to let the positions of the body-side and extension-side mounting hole be aligned with each other vertically. Therefore, by inserting the mounting means into those mounting holes, the body blade and the extension blade can be mounted together easily in a preset extended attitude.

The body blade and the extension blade positioned in a positional relation corresponding to the extended attitude are prevented from pivoting around the mounting means by mutual abutment of the positioning portions, so that both blades can be held in a preset extended attitude even after insertion of the mounting means. Mounting pins are mentioned as an example of the mounting means, but no limitation is made thereto insofar as a member adopted as the mounting means has a pivotable mounting function.

Thus, according to the present invention, the extension blade can be mounted easily to the body blade.

More specifically, the positioning portions include a positioning pin provided in one of the body-side mounting portion and the extension-side mounting portion and a cutout portion formed in the other. The positioning pin is formed in a vertically extending manner, while the cutout portion is open to one side in the transverse direction and are formed vertically through the positioning portions. The positioning pin is inserted in the transverse direction into the cutout portion, whereby not only relative movements in both longitudinal and transverse directions of the body blade and the extension blade are inhibited but also the body blade and the extension blade are inhibited from pivoting around the positioning pin.

According to this configuration, by inserting the positioning pin into the cutout portion, not only the body blade and the extension blade can be abuttingly fixed at front and rear positions and at transverse positions corresponding to the extended attitude, but also the pivoting of both blades around the positioning pin can be inhibited. Thus, by such a simple method of inserting the positioning pin into the cutout portion, the body-side mounting hole and the extension-side mounting hole can be vertically aligned with each other.

In this blade, the positioning portions have respective rotation inhibiting portions, the rotation inhibiting portions being provided in the body-side mounting portion and the extension-side mounting portion respectively and adapted to come into abutment against each other in the longitudinal or transverse direction upon insertion of the positioning pin into the cutout portion. It is preferable that the pivoting of the body blade and the extension blade around the positioning pin be inhibited by mutual abutment of the rotation inhibiting portions.

According to this configuration, by inserting the positioning pin into the cutout portion and by bringing the rotation inhibiting portions respectively provided in the body-side mounting portion and the extension-side mounting portion into mutual abutment, those mounting portions can be inhibited from rotating around the positioning pin.

For swivel stop of the body blade and the extension blade, the positioning pin and the cutout portion may be formed in mutually fitting sectional shape so as to inhibit the body blade and the extension blade from pivoting around the positioning pin.

According to this configuration, by fitting the positioning pin and the cutout portion with each other, it is possible to effect the swivel stop of the body blade and the extension blade.

By inserting the mounting pin into the body-side mounting hole and the extension-side mounting hole, the extension blade is adapted to be mounted the body blade in a housing attitude in which the extension surface is housed on a back side of the working surface. Second positioning portions are provided in the body-side mounting portion and the extension-side mounting portion respectively and adapted to come into abutment against each other to position the body blade and the extension blade in a positional relation corresponding to the housing attitude. The second positioning portion includes a second positioning pin and a second cutout portion formed in the other mounting portion. The second cutout portion is open to one side in the longitudinal direction and are formed as vertical through portion. The second positioning pin is inserted longitudinally into the second cutout portion, whereby not only the position of the body-side mounting hole and the position of the extension-side mounting hole are vertically aligned with each other, but also the body-side mounting portion and the extension-side mounting portion are inhibited from pivoting around the mounting pin.

According to this configuration, by inserting the second positioning pin into the second cutout portion, the body blade and the extension blade are abuttingly fixed at their longitudinal and transverse positions corresponding to the housing attitude, whereby the position of the body-side mounting hole and the position of the extension-side mounting hole can be vertically aligned with each other. In this state, therefore, by inserting the mounting pin into the body-side and extension-side mounting holes, the extension blade can be mounted in the housing attitude to the body blade.

The body blade and the extension blade which have been set to a positional relation corresponding to the housing attitude are inhibited from pivoting around the mounting pin by inserting the second positioning pin into the second cutout portion, so that both blades can be held in a preset extended attitude even after the insertion of the mounting pin.

Further, in this housing attitude, the extension surfaces can be housed on the back side of the working surface and therefore the extension blade can be mounted compactly in the housing attitude to the body blade even when extension of the working surface is not required.

In the blade of the working machine it is preferable that the second positioning pin and the second cutout portion be formed in a mutually fitting sectional shape so as to inhibit the body blade and the extension blade from pivoting around the second positioning pin.

According to this configuration it is possible to effect the swivel stop of the body blade and the extension blade by fitting the positioning pin and the cutout portion with each other.

Further, it is preferable that in each of the extended attitude and the housing attitude, one of the body-side mounting portion and the extension-side mounting portion covers at least a part of upper surface of the other and that the positioning pin is provided in one mounting portion, while in the other mounting portion the cutout portion and the second cutout portion be formed within a range of covering formed by one mounting portion.

According to this configuration, an abutting position of the positioning pin against the cutout portion and the second cutout portion are received within the covered range in a preset extended attitude and the housing attitude, whereby it is possible to suppress deposition of soil, sand and the like in the abutting position of the positioning pin against the cutout portion and the second cutout portion during operation of the working machine. Consequently, it is possible to suppress the deposition of soil, sand and the like between the body blade and the extension blade and hence possible to effect the positioning positively when positioning of both blades is performed again after the operation.

BRIEF DESCRIPTION OF THE DRAWINGS

FIGS. 1A and 1B illustrate a hydraulic excavator according to an embodiment of the present invention, of which FIG. 1A is a side view of the hydraulic excavator and FIG. 1B is a bottom view thereof;

FIGS. 4A and 4B are perspective views showing enlarged principal portions of a blade shown in FIG. 2, of which FIG. 4A shows a state in which an extension blade is attached in an extended attitude to a body blade and FIG. 4B shows a state in which the extension blade is attached in a housing attitude to the body blade;

FIGS. 5A and 5B are perspective views showing enlarged principal portions of a blade according to another embodiment of the present invention, of which FIG. 5A shows a state in which an extension blade is attached in an extended attitude to a body blade and FIG. 5B shows a state in which the extension blade is attached in a housing attitude to the body blade; and FIGS. 6A and 6B are perspective views showing enlarged principal portions of a blade according to a further embodiment of the present invention, of which FIG. 6A shows a state in which an extension blade is attached in an extended attitude to a body blade and FIG. 6B shows a state in which the extension blade is attached in a housing attitude to the body blade.

DESCRIPTION OF THE PREFERRED EMBODIMENTS

Preferred embodiments of the present invention will be described hereinunder with reference to the drawings.

Figure 1A:
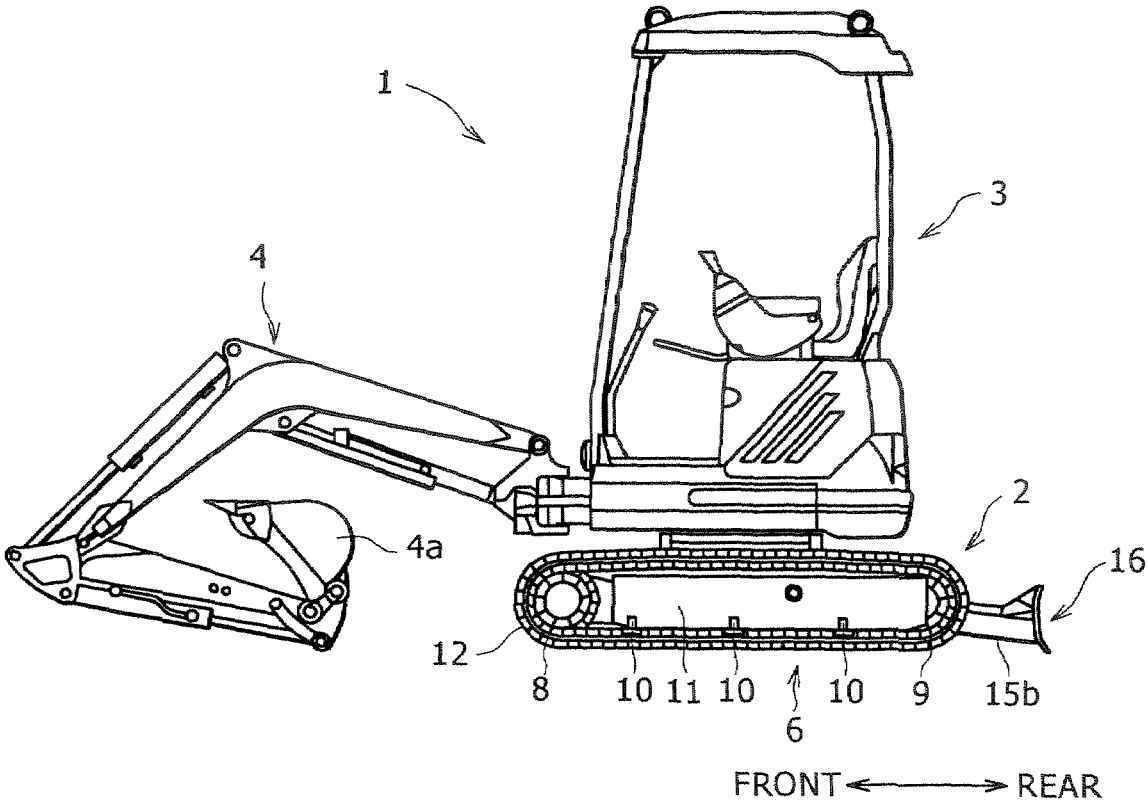
Figure 1B:
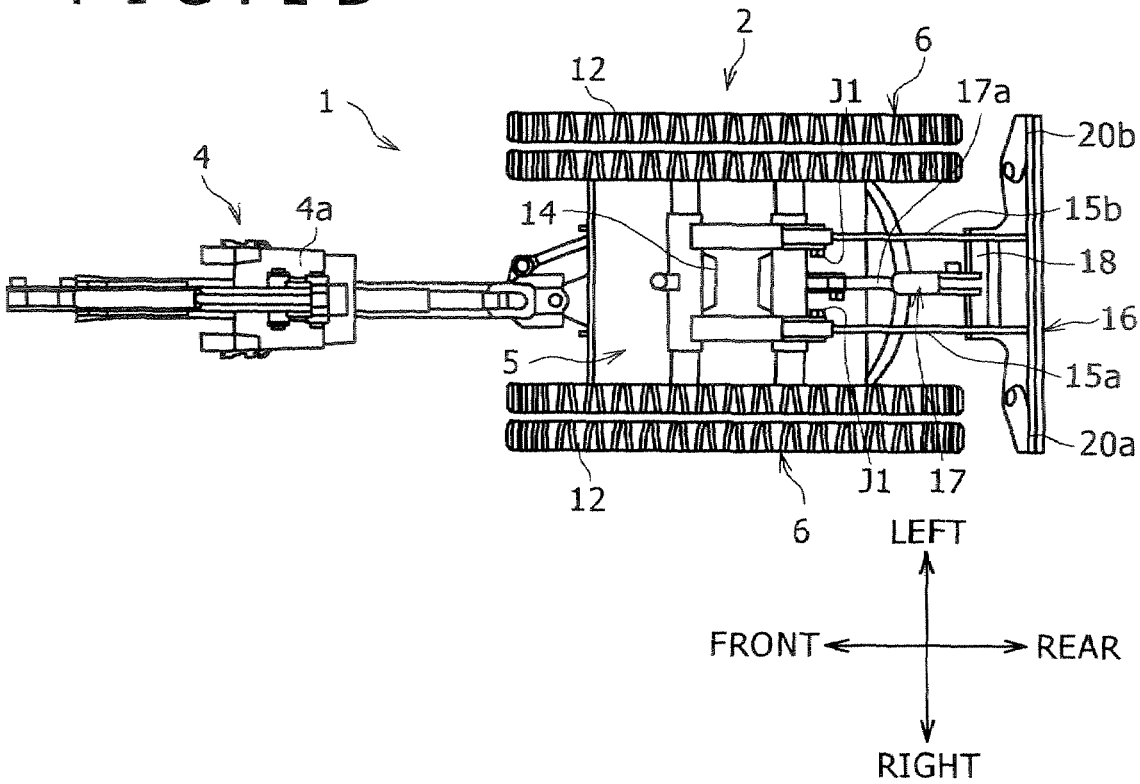
Figure 2:
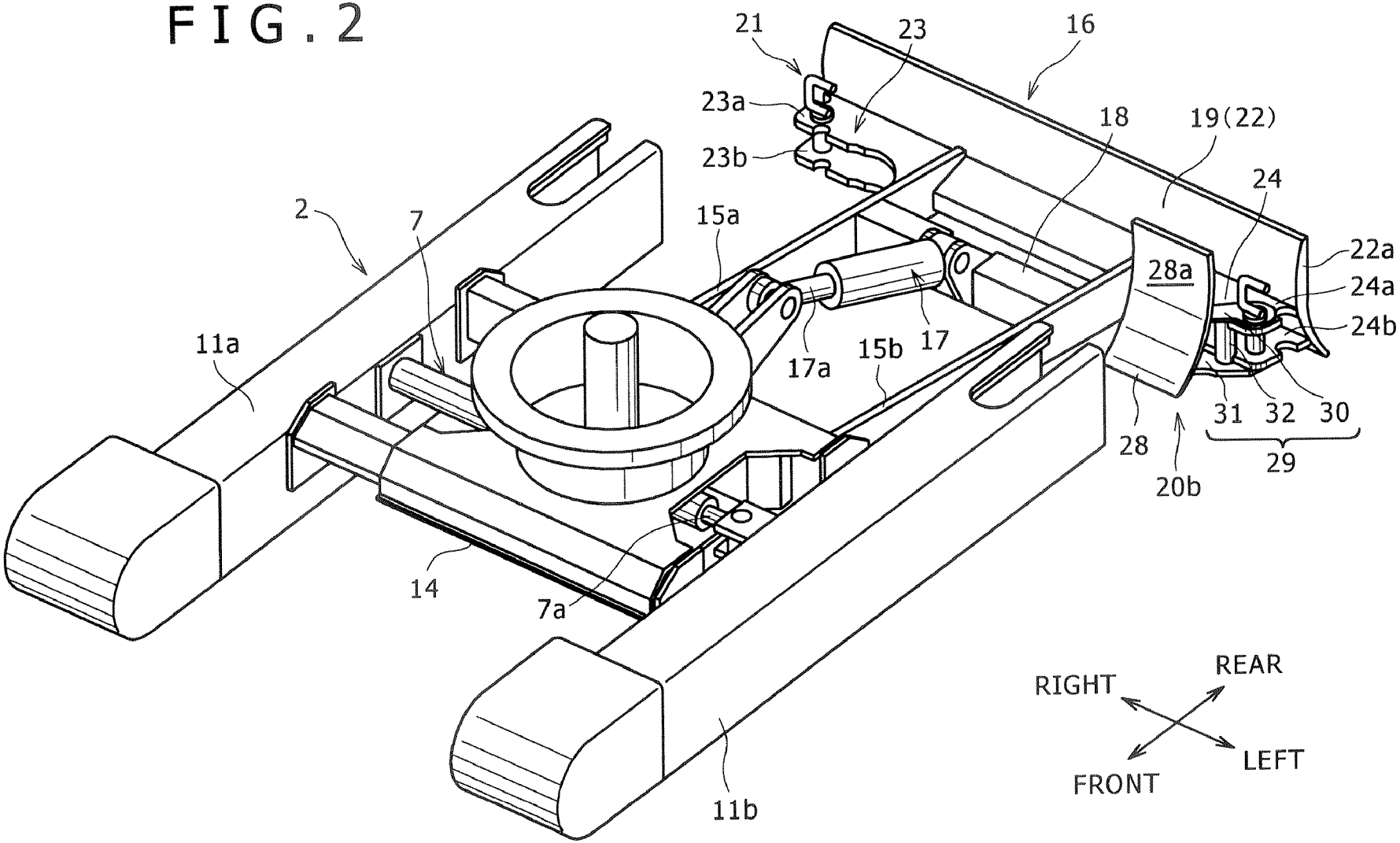
FIG. 2 is a perspective view showing principal portions of a lower traveling body shown in FIG. 1.

FIGS. 1A and 1B illustrate a hydraulic excavator according to an embodiment of the present invention, of which FIG. 1A is a side view of the hydraulic excavator and FIG. 1B is a bottom view thereof. FIG. 2 is a perspective view showing principal portions of a lower traveling body 2.

Referring to FIGS. 1A, 1B and FIG. 2, a hydraulic excavator 1 as an example of the working machine of the present invention includes the lower traveling body 2, an upper rotating body 3 mounted rotatably on the lower traveling body 2, and an attachment 4 attached to the upper rotating body 3 so as to be able to rise and fall, with a bucket 4*a* being attached to a tip of the attachment 4.

The lower traveling body 2 includes a main frame 5 on which the upper rotating body 3 is mounted, a pair of crawlers 6 disposed on both sides of the main frame 5, and a hydraulic cylinder 7 for contact and separation of the crawlers 6. In the following description it is assumed that an opposed direction of the crawlers 6 (a width direction of a hydraulic excavator 1) is a transverse direction and a longitudinal direction of the crawlers 6 is the longitudinal direction.

The crawlers 6 each include driven wheels 8 and driving wheels 9 as a pair of front and rear wheels and a plurality of lower rollers 10 arranged between both wheels 8 and 9. The crawlers 6 further include a pair of right and left crawler frames 11*a* and 11*b* which support the wheels 8 to 10 rotatably around right and left axes, and crawler belts 12 wound round the wheels 8 to 10. The crawler belts 12 are rotated with rotation of the driving wheels 9, whereby the crawlers 6 can move back and forth.

The hydraulic cylinder 7 is disposed between the crawler frames 11*a* and 11*b* so as to extend through the main frame 5. A rod 7*a* of the hydraulic cylinder 7 is adapted to expand and contract in the transverse direction, whereby the crawler frames 11*a* and 11*b* move into contact with and away from each other in the transverse direction.

The main frame 5 includes a frame body 14 on which the upper rotating body 3 is mounted, a pair of right and left arms 15*a* and 15*b* extending backward from the frame body 14, a blade 16 engaged with tips of the arms 15*a* and 15*b*, and a lift cylinder 17 for raising and lowering the blade 16.

The arms 15*a* and 15*b* are supported in a cantilevered state by the frame body 14 so as to be pivotable around right and left shafts J1 (see FIG. 1). A stay 18 is mounted bridgewise between the arms 15*a* and 15*b* at intermediate positions. A rod 17*a* of the lift cylinder 17 expands and contracts between the stay 18 and the frame body 14, whereby the tips of the arms 15*a* and 15*b* rise and fall around the right and left shafts J1.

Figure 3:
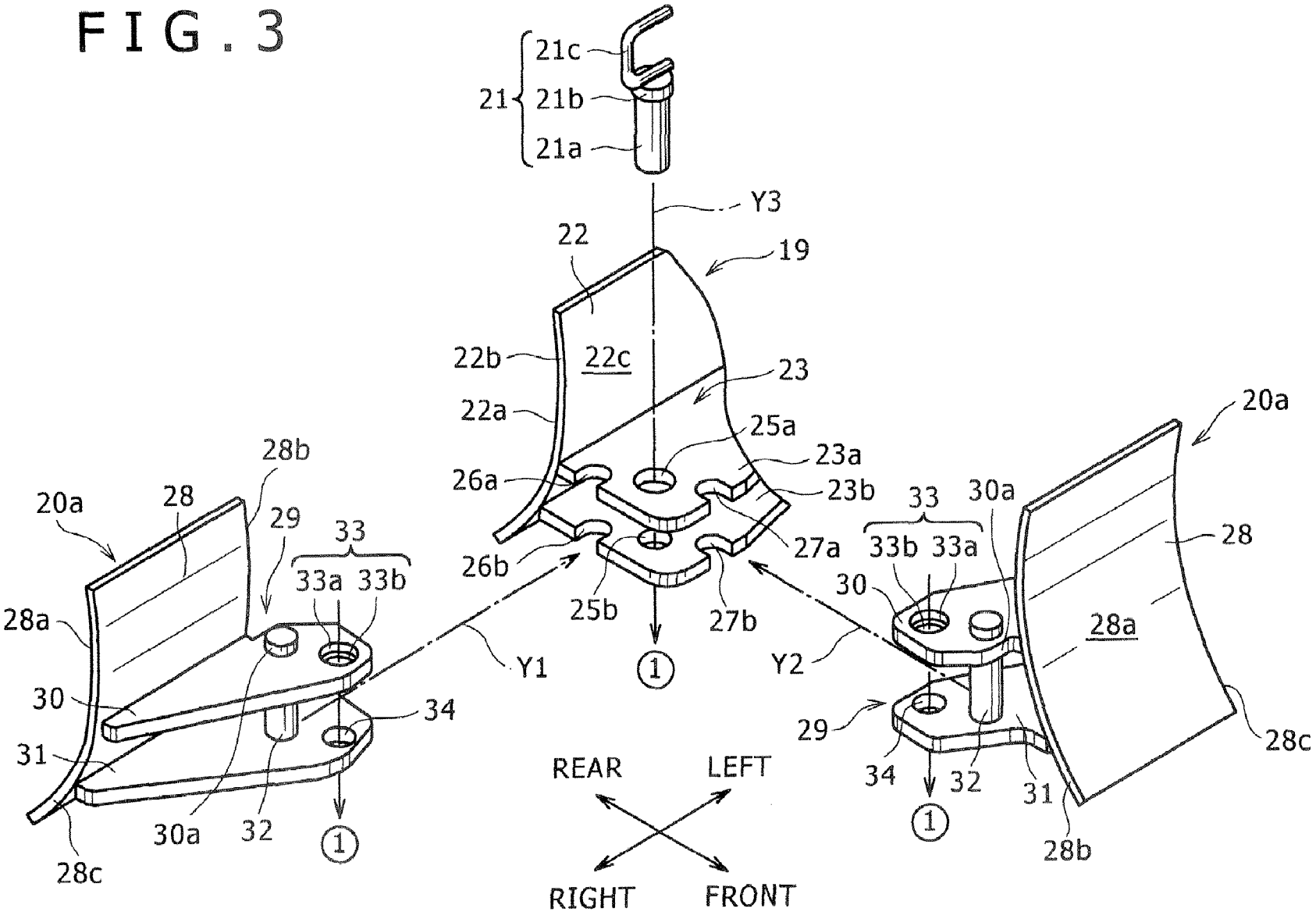
FIG. 3 is a perspective view showing principal portions of the lower traveling body shown in FIG. 1.

Referring now to FIGS. 2 and 3, the blade 16 will be described below. FIG. 3 is a perspective view showing enlarged principal portions of the blade 16 shown in FIG. 2.

The blade 16 includes a body blade 19 attached to the tips of the arms 15*a* and 15*b*, extension blades 20*a* and 20*b* (see FIG. 1B) capable of being attached to and detached from both right and left end portions of the body blade 19, and a mounting pin 21 for connecting the body blade 19 and the extension blades 20*a* and 20*b*.

The body blade 19 includes a soil removing board 22 extending in the transverse direction and a pair of right and left body-side mounting portions 23 and 24 extending from the soil removing board 22 toward the frame body 14 (forward in the figure). A front surface of the soil removing board 22 is fixed to the tips of the arms 15*a* and 15*b*.

The soil removing board 22 has a curved side shape which is open outward (backward in the figure) and its rear surface serves as a working surface 22*a* for removal of soil.

The body-side mounting portion 23 is formed on a right side of the arm 15*a*, while the body-side mounting portion 24 is formed on a left side of the arm 15*b*.

The body-side mounting portion 23 includes mounting plates 23*a* and 23*b* as a pair of upper and lower mounting plates.

The body-side mounting portion 24 includes mounting plates 24*a* and 24*b*. Since the body-side mounting portions 23 and 24 are symmetric right and left, a description will be given below only about the body-side mounting portion 23.

As shown in detail in FIG. 3, the mounting plate 23*a* is formed with a body-side mounting hole 25*a*, a cutout portion 26*a*, and a second cutout portion 27*a*.

On the other hand, the mounting plate 23*b* is formed with a body-side mounting hole 25*b*, a cutout portion 26*b*, and a second cutout portion 27*b*.

The body-side mounting holes 25*a* and 25*b* are circular holes formed vertically through the mounting plates 23*a* and 23*b* respectively so as to overlap each other in plan. The body-side mounting holes 25*a* and 25*b* have a diameter permitting insertion therethrough of a small-diameter portion 21*a* of a mounting pin 21 which will be described later.

The cutout portions 26*a* and 26*b* are U-shaped grooves in plan which extend vertically through the mounting plates 23*a* and 23*b* so as to overlap each other in plan and which are open leftwards.

The second cutout portions 27*a* and 27*b* are U-shaped grooves in plan which extend vertically through the mounting plates 23*a* and 23*b* so as to overlap each other and which are open forward.

On the other hand, the extension blades 20*a* and 20*b* each include an extension board 28 having an extension surface 28*a* and an extension-side mounting portion 29 extending from the extension board 28 toward the back side of the extension surface 28*a*. In preset extended attitude (the attitude of FIG. 4A) and housing attitude (the attitude of FIG. 4B) the extension blades 20*a* and 20*b* can be attached to and detached from the right and left end portions of the body blade 19. Since the extension blades 20*a* and 20*b* are symmetric right and left, only the right-hand extension blade 20*a* will be described below.

The extension board 28 has a curved side shape corresponding to the soil removing board 22. That is, the extension board 28 has a side shape such that the extension surface 28*a* thereof becomes flush with the working surface 22*a* of the soil removing board 22 when it is attached in its extended attitude shown in FIG. 4A to the body blade 19.

Further, when the extension board 28 is attached in its extended attitude to the body blade 19, a side face 28*b* thereof comes into abutment against a side face 22*b* of the soil removing board 22. That is, in the present embodiment, the side face 28*b* of the extension board 28 and the side face 22*b* of the soil removing board 22 constitute an example of a rotation inhibiting portion.

Figure 4B:
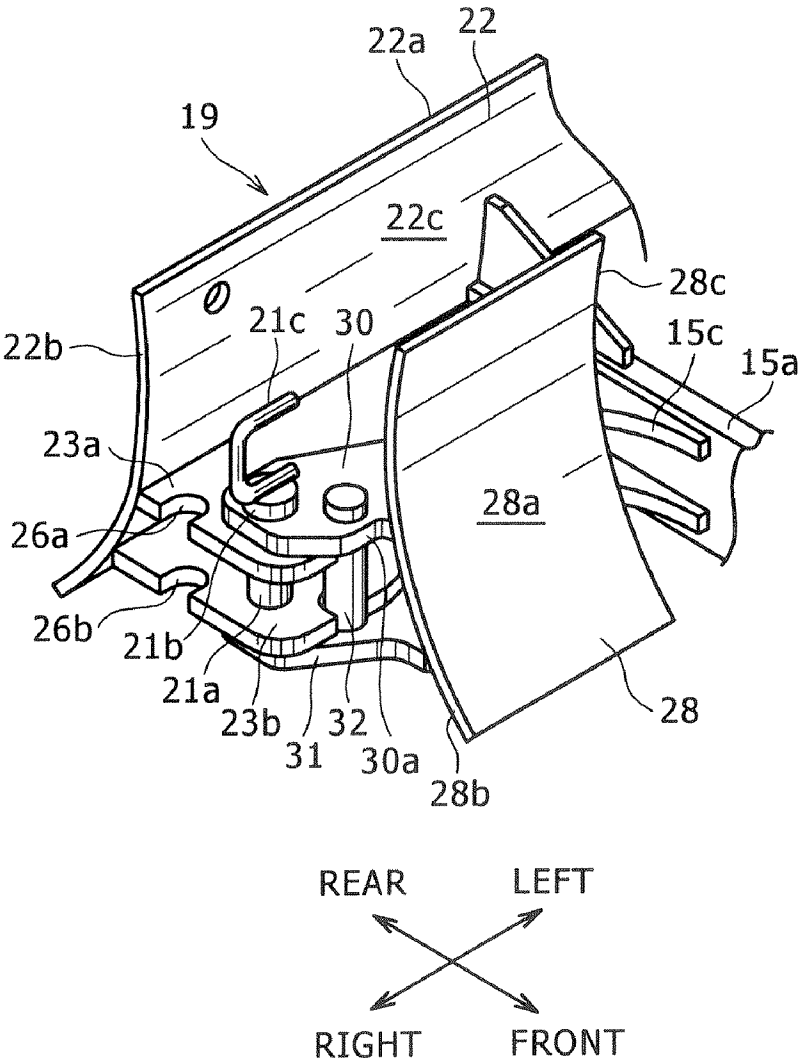

On the other hand, when the extension board 28 is attached in the housing attitude shown in FIG. 4B to the body blade 19, a side face 28*c* on the side opposite to the side face 28*b* comes into abutment against an outer side face 15*c* of the arm 15*a*. As a result, the body blade 19 and the extension blade 20*a* which have been set to a positional relation corresponding to the housing attitude are inhibited from pivoting around a positioning pin 32 which will be described later.

Referring again to FIG. 3, the extension-side mounting portion 29 includes mounting plates 30 and 31 as a pair of upper and lower mounting plates and a positioning pin 32 extending vertically through the mounting plates 30 and 31.

Figure 4A:
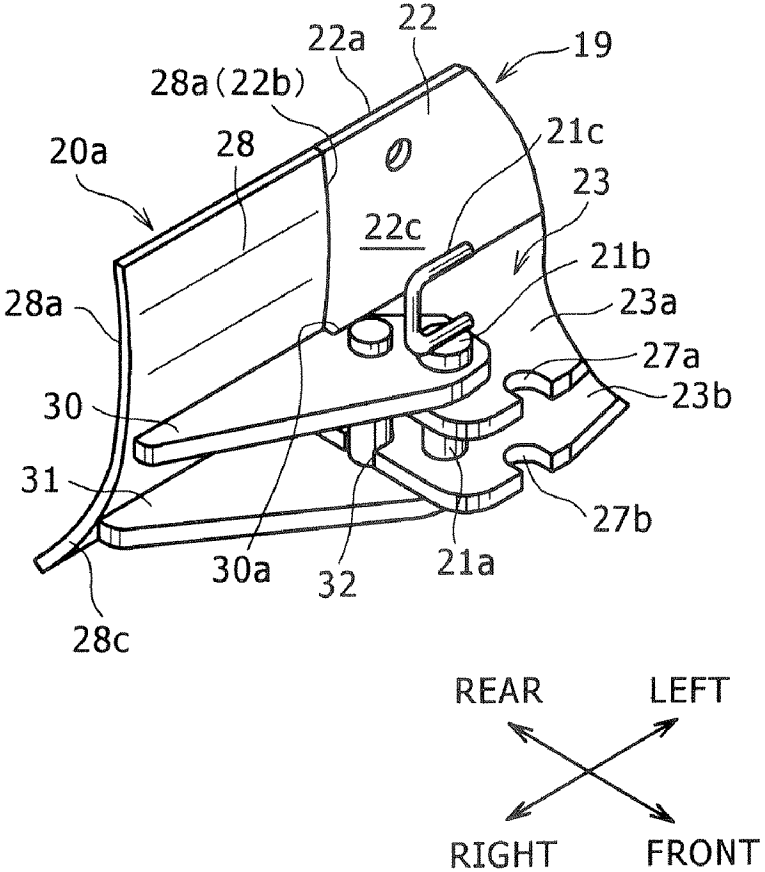

The mounting plates 30 and 31 are spaced a vertical distance from each other which distance permits the body-side mounting portion 23 or 24 to be sandwiched in between the mounting plates 30 and 31. When the mounting plate 30 is attached in a preset extended attitude to the body blade 19, it covers the right edge portion of the mounting plate 23*a* of the body blade 19, as shown in FIG. 4A, while when the mounting plate 30 is attached in the housing attitude to the body blade 19, it covers a rear edge portion of the mounting plate 23*a* of the body blade 19, as shown in FIG. 4B. The cutout portion 26*a* and the second cutout portion 27*a* are formed within this covered area. Therefore, in a preset extended attitude or the housing attitude, it is possible to suppress deposition of soil, sand and the like in an engaged portion between the positioning pin 32 and the cutout portion 26*a* or the second cutout portion 27*a*.

Further, when the mounting plate 30 is attached in a preset extended attitude to the body blade 19, a side face 30*a* thereof comes into abutment against a front surface 22*c* of the soil removing board 22.

That is, in this embodiment, the side face 30*a* of the mounting plate 30 and the front surface 22*c* of the soil removing board 22 constitute an example of the rotation inhibiting portion.

Referring to FIG. 3, circular extension-side mounting holes 33 and 34 are formed as upper and lower through holes in the mounting plates 30 and 31, respectively.

The extended-side mounting hole 33 includes a spot-faced portion 33*a* which is open to an upper surface of the mounting plate 30 and an inserting portion 33*b* formed concentrically with the spot-faced portion 33*a*. A diameter of the spot-faced portion 33*a* is set to a value which permits insertion therethrough of a large-diameter portion 21*b* of a mounting pin 21 to be described later, while the diameter of the inserting portion 33*b* is set to a value which permits insertion therethrough of a small-diameter portion 21*a* of the mounting pin 21. That is, the extension-side mounting hole 33 can receive the mounting pin 21 from above while preventing downward dislodgment of the large-diameter portion 21*b*.

A diameter of the extension-side mounting hole 34 is set approximately equal to the diameter of the inserting portion 33*b*.

The inserting portion 33*b* of the extension-side mounting hole 33 and the extension-side mounting hole 34*b* are formed in positions overlapping each other in plan.

The positioning pin 32 is a cylindrical member fixed to the mounting plates 30 and 31. A diameter of the positioning pin 32 is set so that the same pin can be inserted from the right side into the cutout portions 26*a* and 26*b* (hereinafter referred to generically as the cutout portion 26) and can be inserted from the front side to the second cutout portions 27*a* and 27*b* (hereinafter referred to generically as the second cutout portion 27).

The following description is now provided about the positional relation of the extension-side mounting holes 33 and 34 to the positioning pin 32 and the positional relation of the body-side mounting holes 25*a* and 25*b* (hereinafter referred to as the body-side mounting hole 25) to the cutout portion 26 or the second cutout portion 27.

As indicated by arrow Y1 in FIG. 3, when the extension surface 28*a* is turned backward and then the positioning pin 32 is inserted into the cutout portion 26 from the right side, the positioning pin 32 comes into abutment against the inner side face of the cutout portion 26, whereby leftward and longitudinal movements of the positioning pin 32 are inhibited. In this state, the body-side mounting hole 25 and the extension-side mounting holes 33 and 34 are located so as to overlap each other vertically.

On the other hand, as indicated by arrow Y2 in FIG. 3, when the extension surface 28*a* is turned forward and then the positioning pin 32 is inserted from the front side into the second cutout portion 27, the positioning pin 32 comes into abutment against the inner side face of the second cutout portion 27, whereby backward and transverse movements of the positioning pin 32 are inhibited. In this state, the body-side mounting hole 25 and the extension-side mounting holes 33 and 34 are located so as to overlap each other vertically.

By such abutment of the positioning pin 32 against the inner side face of the cutout portion 26 or the second cutout portion 27, longitudinal and transverse positions of the body blade 19 and the extension blade 20*a* are inhibited. That is, in the present embodiment, the positioning pin 32 and the cutout portion 26 constitute an example of the positioning portion, and the positioning pin 32 and the inner side face of the second cutout portion 27 also constitute an example of the positioning portion.

The mounting pin 21 is a rod-like member having the small-diameter portion 21*a* and the large-diameter portion 21*b* connected together concentrically. The mounting pin 21 is provided with a handle portion 21*c* fixed to the large-diameter portion 21*b*.

Now, with reference to FIG. 3, FIGS. 4A and 4B, a description will be given below about a method for mounting the extension blades 20. In the following description, reference will be made to a method for mounting the extension blade 20*a* to be mounted to the right side of the body blade 19.

FIGS. 4A and 4B are perspective views showing enlarged principal portions of the blade 16 shown in FIG. 2, of which FIG. 4A shows an attached state of the extension blade 20*a* in a preset extended attitude to the body blade 19, while FIG. 4B shows an attached state of the extension blade 20*a* in the housing attitude to the body blade 19.

For extending the working surface 22*a* of the body blade 19 with the extension blade 20*a*, first the extension surface 28*a* is turned backward and then the positioning pin 32 of the extension blade 20*a* is inserted from the right side into the cutout portion 26, as indicated by arrow Y1 in FIG. 3.

As a result, as shown in FIG. 4A, an outer periphery surface of the positioning pin 32 and the inner side face of the cutout portion 26 are put in abutment against each other, so that leftward and longitudinal movements of the positioning pin 32 relative to the body blade 19 are inhibited. Thus, the extension blade 20*a* can be located at longitudinal and leftward positions corresponding to the extended attitude of the extension blade 20*a* relative to the body blade 19 and it is possible to align the body-side mounting hole 25 and the extension-side mounting holes 33 and 34 with each other easily. In this state, the side face 22*b* of the soil removing board 22 and the side face 28*b* of the extension board 28 are put in abutment against each other and likewise the side face 30*a* of the mounting plate 30 and the front surface 22*c* of the soil removing board 22 are put in abutment against each other, whereby the rotation of the body blade 19 and the extension blade 20*a* around the positioning pin 32 is inhibited. Therefore, the body-side mounting hole 25 and the extension-side mounting holes 33 and 34 are disposed in a vertically aligned manner.

Next, as indicated by arrow Y3 in FIG. 3, the mounting pin 21 is inserted from above into the body-side mounting hole 25 and the extension-side mounting holes 33 and 34 to connect the body blade 19 and the extension blade 20*a* in a preset extended attitude as shown in FIG. 4A.

In this extended attitude, the longitudinal movement of the extension blade 20*a* relative to the body blade 19 is inhibited by engagement between the positioning pin 32 and the inner side face of the cutout portion 26. Consequently, the extension blade 20*a* is made unrotatable around the mounting pin 21.

On the other hand, when the extension of the body blade 19 by the extension blade 20*a* is not required, the extension blade 20*a* can be mounted to the body blade 19 in its housing attitude of being housed on the back side of the working surface 22*a* (housed inside the right and left sides of the body blade 19).

In this case, first the extension surface 28*a* is turned forward and then the positioning pin 32 is inserted into the second cutout portion 27 from the front side, as indicated by arrow Y2 in FIG. 3.

As a result, as shown in FIG. 4B, an outer periphery surface of the positioning pin 32 and the inner side face of the second cutout portion 27 come into abutment against each other, whereby the backward and transverse movements of the positioning pin 32 relative to the body blade 19 are inhibited. In this way the extension blade 20*a* can be located at rear and transverse positions corresponding to the housing attitude with respect to the body blade 19. In this state, moreover, the side face 28*c* of the extension board 28 and the outer side face 15*c* of the arm 15*a* come into abutment against each other, whereby the rotations of the body blade 19 and the extension blade 20*a* around the positioning pin 32 are inhibited. Therefore, the body-side mounting hole 25 and the extension-side mounting holes 33 and 34 are arranged in a vertically aligned state.

Next, as indicated by arrow Y3 in FIG. 3, the mounting pin 21 is inserted from above into the body-side mounting hole 25 and the extension-side mounting holes 33 and 34 to connect the body blade 19 and the extension blade 20*a* in the housing attitude, as shown in FIG. 4B.

In this housing attitude, the movement in the transverse direction of the extension blade 20*a* relative to the body blade 19 is inhibited by engagement between the positioning pin 32 and the second cutout portion 27. Consequently, the extension blade 20*a* is made unrotatable around the mounting pin 21.

According to the hydraulic excavator 1, as described above, the position of the body-side mounting hole 25 and that of the extension-side mounting holes 33 and 34 can be vertically aligned with each other by inserting the positioning pin 32 into the cutout portion 26. Thus, the body blade 19 and the extension blades 20*a* and 20*b* can be easily mounted together in a preset extended attitude by inserting the mounting pin 21 into the mounting holes 25, 33 and 34.

When the body blade 19 and the extension blades 20*a* and 20*b* are set to the positional relation corresponding to the extended attitude, the rotation thereof around the mounting pin 21 is inhibited by abutment of the positioning pin 32 against the inner side face of the cutout portion 26. Therefore, the blades 19, 20*a* and 20*b* can be held in a preset extended attitude even after insertion of the mounting pin 21.

Thus, according to the hydraulic excavator 1, the extension blades 20*a* and 20*b* can be attached easily to the body blade 19.

According to the configuration of the this embodiment, the positioning pin 32 is inserted into the cutout portion 26 and the side face 22*b* of the soil removing board 22 and the side face 28*b* of the extension board 28 are brought into abutment against each other and the front face 22*c* of the soil removing board 22 and the side face 30*a* of the mounting board 30 are brought into abutment against each other. With this configuration, the body-side mounting portions 23 and 24 and the extension-side mounting portion 29 can be inhibited from rotating around the positioning pin 32.

According to this embodiment, by inserting the positioning pin 32 into the second cutout portion 27 to abuttingly fix the body blade 19 and the extension blades 20*a* and 20*b* at the longitudinal and transverse positions corresponding to the housing attitude, it is possible to vertically align the position of the body-side mounting hole 25 and that of the extension-side mounting holes 33 and 34 with each other. Therefore, by inserting the mounting pin 21 into the body-side mounting hole 25 and the extension-side mounting holes 33 and 34 in this state, the extension blades 20*a* and 20*b* can be mounted in the housing attitude to the body blade 19.

By inserting the positioning pin 32 into the second cutout portion 27, the body blade 19 and the extension blade 20*a* which have been set to the positional relation corresponding to the housing attitude are inhibited from pivoting around the mounting pin 21. Therefore, both blades can be held in a preset extended attitude even after the insertion of the mounting pin 21.

Further, in this housing attitude, the extension surface 28*a* can be housed on the back side forward) of the working surface 28*a*, so that even when extension of the working surface 22*a* is not required, the extension blades 20*a* and 20*b* can be mounted in the housing attitude compactly to the body blade 19.

Figure 5B:
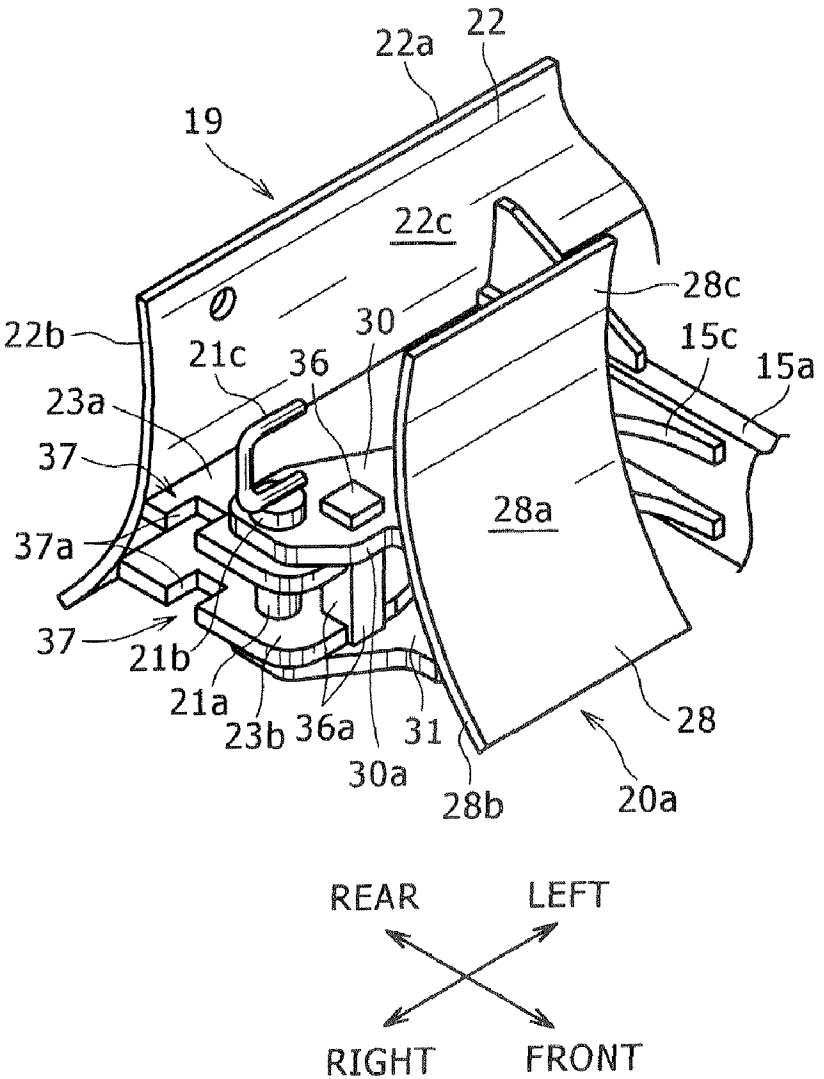
Figure 5A:
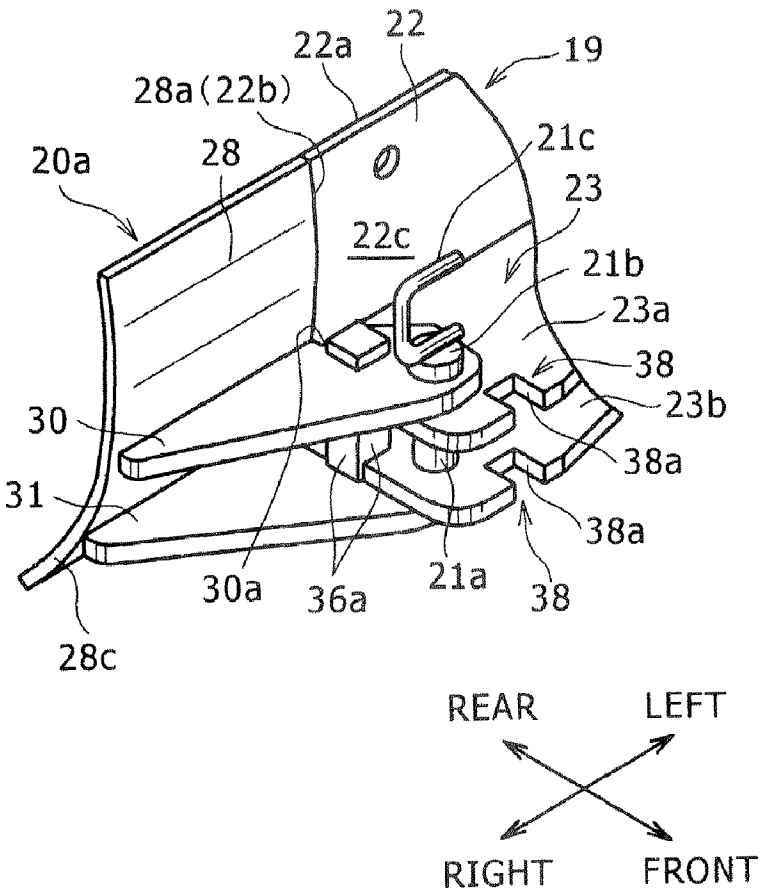

Although the cylindrical positioning pin 32 and U-shaped cutout portion 26 and the second cutout portion 27 are described in this embodiment, a positioning pin 36 may be formed in the shape of a quadrangular prism and a cutout portion 37 and a second cutout portion 38 may be formed so as to have an opening shape corresponding to a sectional shape of the positioning pin 36, as shown in FIGS. 5A and 5B.

In this embodiment the positioning pin 36 is formed in an extension-side mounting portion 29 so that in a preset extended attitude or the housing attitude four side faces 36*a* thereof are positioned in the longitudinal or the transverse direction.

On the other hand, the cutout portion 37 and the second cutout portion 38 have inner side faces 37*a* and 38*a* respectively which are disposed in ⊐shape in plan so as to be abuttingly engageable with three, out of four, side faces 36*a* of the positioning pin 36.

In this embodiment, by inserting the positioning pin 36 into the cutout portion 37 or the second cutout portion 38, the side faces 36*a* and the inner side faces 37*a* or 38*a* are fitted with each other, whereby not only the transverse and longitudinal movements of the positioning pin 36 can be inhibited, but also the rotation of the extension blade 20*a* (20*b*) around the positioning pin 36 can be suppressed.

In this embodiment, since the rotation of both blades 19 and 20*a* and 20*b* can be inhibited by the positioning pin 36 and the cutout portion 37 or the second cutout portion 38, it is also possible to omit abutment between the side face 22*b* of the soil removing board 22 and the side face 28*b* of the extension board 28, abutment between the side face 30*a* of the mounting plate 30 and the front surface 22*c* of the soil removing board 22, and abutment between the side face 28*c* of the extension board 28 and the outer side face 15*c* of the arm 15*a*.

Figure 6B:
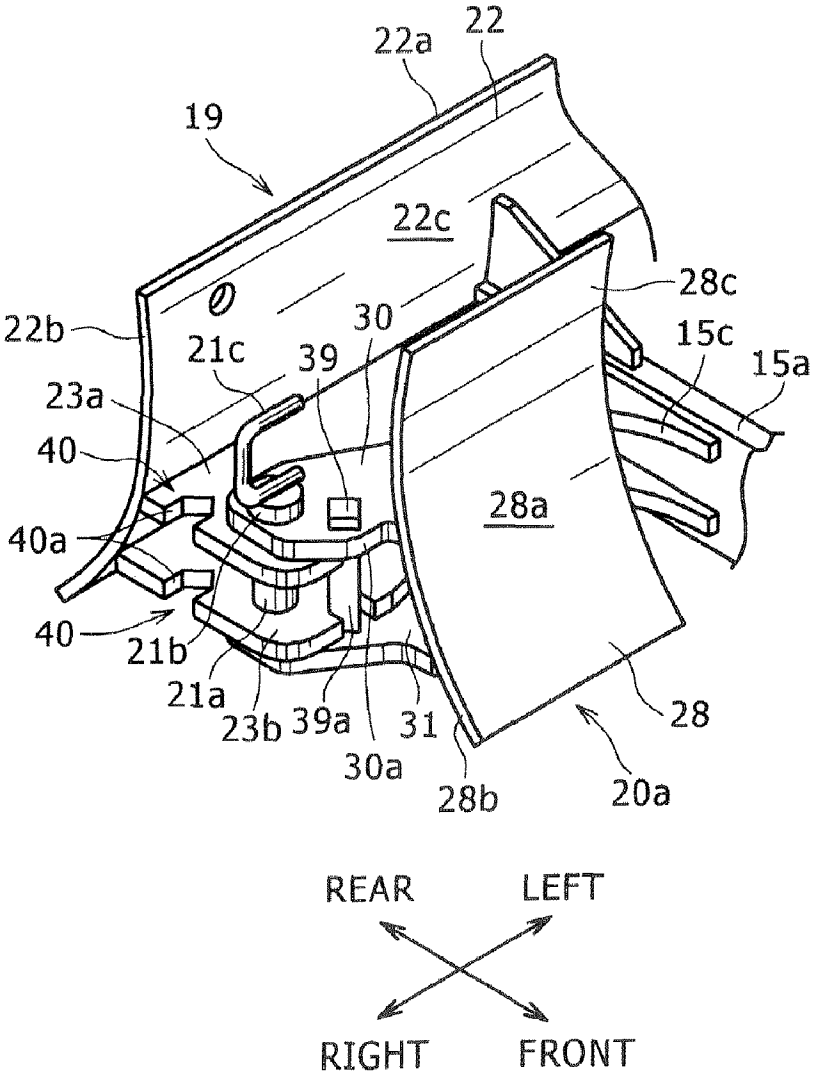
Figure 6A:
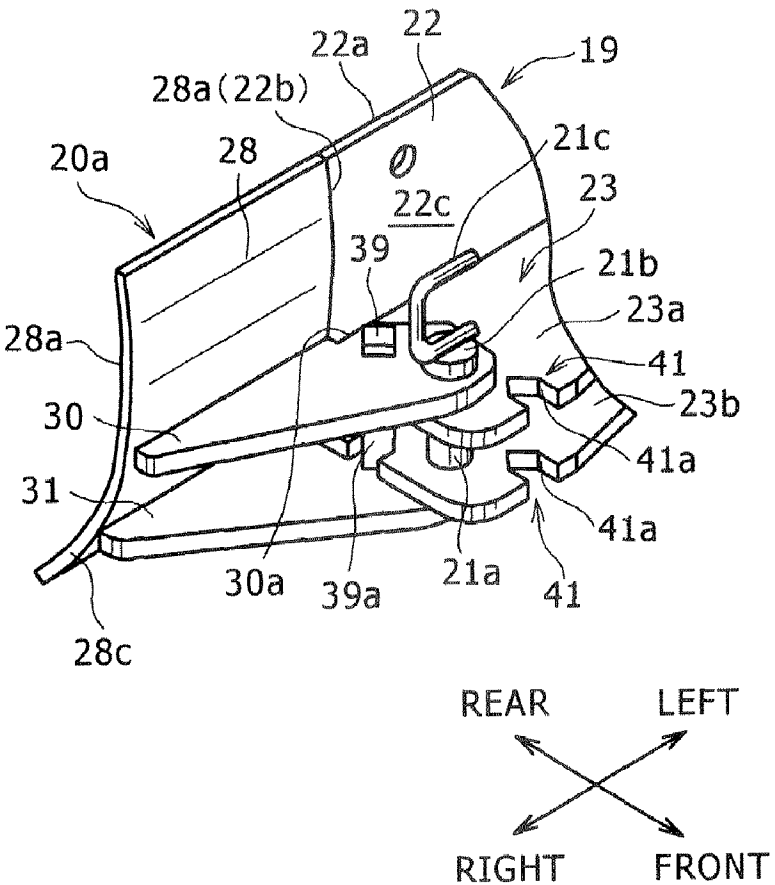

Although in this embodiment the side faces 36*a* of the positioning pin 36 are positioned in the longitudinal or transverse direction, a positioning pin 39 may be disposed in such a manner that side faces 36*a* thereof intersect both longitudinal and transverse directions, as shown in FIGS. 6A and 6B.

More specifically, in the embodiment shown in FIG. 6, the positioning pin 39 has a generally square sectional shape and diagonal lines thereof each extend in the transverse or longitudinal direction.

Accordingly, a cutout portion 40 each have a width dimension corresponding to a diagonal line of the positioning pin 39 and are open to one side (leftward in FIGS. 6A and 6B) in the transverse direction. The cutout portion 40 each have an opening shape (a shape engaging a corner portion of the positioning pin 39) including an inner side face 40*a* which becomes narrower in the inserting direction (leftward) of the positioning pin 39.

Likewise, a second cutout portion 41 each have a width dimension corresponding to a diagonal line of the positioning pin 39 and are open forward. The second cutout portion 41 each have an opening shape including an inner side face 41*a* which becomes narrower in the inserting direction (backward) of the positioning pin 39.

Also in this embodiment the side faces 39*a* and the inner side faces 40*a* and 41*a* are fitted together by inserting the positioning pin 39 into the cutout portion 40 or the second cutout portion 41. Therefore, the extension blades 20*a* and 20*b* can be inhibited from transverse and longitudinal movements and at the same time can be prevented from rotating around the positioning pin 39.

Further, according to this embodiment, not only the insertion of the positioning pin 39 is made easier by forming wide opening ends of the cutout portion 40 or the second cutout portion 41 (by forming wide the opening ends correspondingly to a diagonal line of the square sectional shape), but also the body-side mounting hole 25 and the extension-side mounting holes 33 and 34 can be positioned easily by sliding (inducing) the positioning pin 39 along the tapered inner side faces 40*a* and 41*a* of the cutout portion 40 and 41.

Although the invention has been described with reference to the preferred embodiments in the attached figures, it is noted that equivalents may be employed and substitutions made herein without departing from the scope of the invention as recited in the claims.

We claim:

1. A working machine having a blade, said blade comprising:

a body blade having a working surface extending in a transverse direction of the working machine in an attached state to the working machine; and an extension blade attachable to said body blade, said extension blade having an extension surface, the extension blade being positionable in either an extended attitude in which the extension surface extends the working surface of said body blade or a housing attitude in which said extension surface is housed on the back side of the working surface, wherein said body blade is further provided with body-side mounting portions having body-side mounting holes as vertical through holes, said extension blade is further provided with an extension-side mounting portion having an extension-side mounting hole formed vertically contiguously to said body-side mounting hole in a positional relation corresponding to said extended attitude with respect to said body-side mounting portion, said extension blade further comprises pivotable mounting means adapted to be inserted into both said body-side mounting hole and said extension-side mounting hole to thereby connect said body blade and said extension blade removably, and removed to position said extension blade from said extended position to said housing position or from said housing position to said extended position, and positioning portions provided in said body-side mounting portion and said extension-side mounting portion respectively and adapted to come into abutment against each other to position said body blade and said extension blade in a positional relation corresponding to said extended attitude and said housing attitude, said positioning portions coming into abutment against each other in a longitudinal direction orthogonal to both the transverse direction and a vertical direction and also in the transverse direction, thereby allowing the positions of said body-side mounting hole and said extension-side mounting hole to be aligned with each other vertically and inhibiting said body-side mounting portion and said extension-side mounting portion from pivoting around said mounting means, wherein said positioning portions include a positioning pin provided in one of said body-side mounting portion and said extension-side mounting portion and also include two cutout portions formed in the other of said body-side mounting portion and said extension-side mounting portion, said positioning pin being formed in a vertically extending manner, said cutout portions being open to one side of said body-side mounting portion and said extension-side mounting portion in the transverse horizontal direction and being formed vertically, said positioning pin being selectively insertable in the transverse horizontal direction into one or the other of said cutout portions to not only inhibit relative movements in the longitudinal and transverse directions of said body blade and said extension blade but also inhibit said body blade and said extension blade from pivoting around said positioning pin.

2. The working machine according to claim 1, wherein said mounting means is a mounting pin.

3. The working machine according to claim 1, wherein said positioning portions have respective rotation inhibiting portions, said rotation inhibiting portions being provided in said body-side mounting portion and said extension-side mounting portion respectively and adapted to come into abutment against each other in the longitudinal or transverse direction upon insertion of said positioning pin into said cutout portion to inhibit said body blade and said extension blade from pivoting around said positioning pin.

4. The working machine according to claim 1, wherein said positioning pin and said cutout portion are formed in mutually fitting sectional shape so as to inhibit said body blade and said extension blade from pivoting around the positioning pin.

5. The working machine according to claim 1, wherein said second positioning pin and said second cutout portion are formed in a mutually fitting sectional shape so as to inhibit said body blade and said extension blade from pivoting around the second positioning pin.

6. The working machine according to claim 1, wherein in each of said extended attitude and said housing attitude, one of said body-side mounting portion and said extension-side mounting portion covers at least a part of upper surface of the other and said positioning pin is provided in one mounting portion, while in the other mounting portion said cutout portion and said second cutout portion are formed within a range of covering formed by one mounting portion.

7. The working machine according to claim 1 , wherein said cutout portion and said second cutout portion have a plane shape tapered in an inserting direction of said positioning pin.

* * * * *